United States Patent [19]

Date et al.

[11] 4,266,016

[45] May 5, 1981

[54] ANTISTATIC LAYER FOR SILVER HALIDE PHOTOGRAPHIC MATERIALS

[75] Inventors: Sukeaki Date; Seigo Ebato, both of Nagaokakyo, Japan

[73] Assignee: Mitsubishi Paper Mills, Ltd., Tokyo, Japan

[21] Appl. No.: 69,864

[22] Filed: Aug. 27, 1979

[30] Foreign Application Priority Data

Aug. 25, 1978 [JP] Japan ..... 53/103660
Jan. 20, 1979 [JP] Japan ..... 54/5688

[51] Int. Cl.[3] ..... G03C 1/78; G03C 1/96

[52] U.S. Cl. ..... 430/527; 430/529; 430/631

[58] Field of Search ..... 430/529, 531, 451, 624, 430/625, 631, 527

[56] References Cited

U.S. PATENT DOCUMENTS

| | | | |
|---|---|---|---|
| 3,072,484 | 1/1963 | Unruh et al. | 430/527 |
| 3,090,704 | 5/1963 | Collins et al. | 117/138.8 |
| 3,220,848 | 11/1965 | Himmelmann et al. | 430/625 |
| 3,895,950 | 7/1975 | Geiger et al. | 430/631 X |
| 4,008,087 | 2/1977 | Aono et al. | 430/527 |
| 4,166,050 | 8/1979 | Miyazako et al. | 430/625 X |

FOREIGN PATENT DOCUMENTS

| | | | |
|---|---|---|---|
| 51-9434 | 1/1976 | Japan | 430/624 |
| 811153 | 2/1957 | United Kingdom | 430/624 |

*Primary Examiner*—Edward C. Kimlin
*Attorney, Agent, or Firm*—Cushman, Darby & Cushman

[57] ABSTRACT

Silver halide photographic materials having excellent antistatic property and high acceptability for drafting, processing resistance and adhesion to hydrophobic supports can be obtained by providing antistatic layer which comprises (a) a styrene-maleic anhydride copolymer, (b) colloidal silica and (c) at least one compound selected from the group consisting of compounds having at least 2 ethyleneimino groups and compounds having at least 2 epoxy rings and which has a pH value of at least about 5, said antistatic layer being provided on one or both surfaces of the support.

18 Claims, No Drawings

ANTISTATIC LAYER FOR SILVER HALIDE PHOTOGRAPHIC MATERIALS

BACKGROUND OF THE INVENTION

This invention relates to a silver halide photographic material and more particularly it concerns with a silver halide photographic material having an antistatic layer. Furthermore, it relates to a novel antistatic composition and to protection of photographic materials such as photographic printing papers, photographic films, etc. from undesired effect of static electricity by applying said composition to said photographic materials.

Build-up of static electricity on the surface of photographic printing papers and films is a great problem in production or processing of photographic materials. For example, static electricity is generated in photographic printer, slitters and winder. Furthermore, static electricity is generated in unwinding of photographic printing papers or films or in contacting of photographic printing papers or films with a transport roller. When static electricity is built-up, it is discharged to cause often irregular fog patterns (static marks) after development.

Generally, this problem is important especially for high speed silver halide photographic emulsions. Moreover, static electricity causes attraction of dust to photographic materials to bring about undesired phenomena such as water repellent spots, desensitization, fogging, etc. It is known to provide antistatic layers in silver halide photographic materials to avoid said undesired effects caused by static electricity.

Generally, such an antistatic layer constitutes an electroconductive surface and is made of materials capable of releasing static electricity. Representative examples of such materials are surfactants (anionic, cationic and nonionic) and polymers (polyacrylic acid, carboxymethyl cellulose, polycarboxylates, polystyrenesulfonates, etc.). Furthermore, there are such antistatic layers as comprising metallic halides such as sodium chloride, potassium chloride, lithium chloride, copper iodide, tin chloride, etc. as an electroconductive material and water soluble polymers such as PVA as a binder.

However, most of the antistatic layers comprising these antistatic agents cannot be firmly adhered to a photographic support if the support has a hydrophobic surface. Furthermore, such layers cannot stand photographic processing (at 30°-40° C.) and sometimes bring about sludges in a processing solution. When photographic printing papers or films having these antistatic layers are left in the form of a roll or in piled sheets under high temperature and humidity conditions, the emulsion layer or the antistatic layer is peeled off from it's support due to blocking. Thickness of the antistatic layers must be increased to obtain curl balance with emulsion layers containing gelatin. Moreover, fogging, desensitization, unevenness in development, stain, etc. occur due to permeation of the antistatic agent into the surface of emulsions. Especially, high speed silver halide photographic materials have a great many of such problems. Furthermore, sometimes, acceptability for drafting materials is required depending on uses such as industrial recording materials, cards for books, publications, literatures, etc.

SUMMARY OF THE INVENTION

The object of this invention is to provide silver halide photographic light sensitive materials excellent in antistatic property which have sufficiently high acceptability for drafting and resistance to photographic processing, have good curl balance even in thin layer and have sufficiently high adhesion to hydrophobic supports.

DETAILED DESCRIPTION OF THE INVENTION

The above object of this invention can be achieved by silver halide photographic materials comprising a hydrophobic support which has on one or both surfaces thereof a layer of a composition which comprises (a) a styrene-maleic anhydride copolymer, (b) colloidal silica and (c) a compound having at least 2 ethylene-imino groups and/or a compound having at least 2 epoxy rings and which has a pH of at least about 5.

The undesired effect of static electricity can be avoided by using the above mentioned antistatic layer. In this case, it is preferable to provide the antistatic layer on the surface of the support opposite to the surface having the silver halide emulsion layer, namely, as a back layer, but it is also possible to provide it on both surfaces of the support. When the antistatic layer is provided on both surfaces of the support, it is especially useful to separately coat and dry the emulsion layer and the antistatic layer and the antistatic layer on the emulsion layer side can also serve as a subbing layer.

Silver halide photographic materials include photographic printing papers and photographic films prepared using various support materials. The hydrophobic supports used in this invention include, for example, polyethylene laminated papers comprising a paper both surfaces of which are laminated with synthetic resins mainly composed of polyethylene, polypropylene laminated films, polystyrene films, polyethylene terephthalate films, cellulose acetate films, polycarbonate films, etc. Supports having a polyolefin resin surface, such as polyethylene or polypropylene are especially preferred.

The antistatic layer of this invention can be effectively used for black and white and color photographic materials. In this case, these photographic materials can contain subbing layers, colloid protective layers, filter layers, antihalation layers, etc. beside said antistatic layer and one or more photographic emulsion layers. In more detail, the first component (a) which constitutes the antistatic layer composition of this invention is a water-soluble film forming styrene-maleic anhydride copolymer. The styrene-maleic anhydride copolymers used in this invention have a molecular weight of preferably 2,000–500,000, more preferably 5,000–50,000. Said copolymers provide an electroconductivity necessary for making the layer containing them effective as an antistatic layer. Furthermore, said copolymers have also an action of improving the electroconductivity to an appropriate degree by effectively keeping an aqueous composition containing colloidal silica. The second component (b) of the antistatic composition of this invention is a colloidally dispersed silica. This is a material which increases antistatic effect to some extent and further provides acceptability for drafting materials which is a characteristic of this invention.

The preferred colloidal silica in this invention is a colloid solution which is a dispersion of superfine particles (of 5–50 mμ, preferably 10–20 mμ in diameter) of silica anhydride ($SiO_2$) in mainly water. The dispersion medium is generally water, but methanol and the like may also be used. In addition, the colloid solution contains an alkali component as a colloid stabilizer. For example, it may contain $Na_2O$, $NH_3$, formamide, ethylamine, morpholine, etc.

Example of commercially available colloidal silica advantageously used in this invention is "Snowtex" produced by Nissan Kagaku Kogyo K. K.

The third component (c) makes it possible to allow the layer to firmly adhere to the support.

It has been unexpectedly found that the third component which is a compound having at least 2 ethyleneimino groups in a molecule and/or a compound having at least 2 epoxy rings in a molecule further increases the antistatic ability and acceptability for drafting of the composition of the first component (a) and the second component (b). Preferable result can be obtained by the combination use of said compound having ethyleneimino groups and said compound having epoxy rings.

Representative examples of the compounds having at least 2 ethyleneimino groups in a molecule are shown below, but these examples do not limit this invention.

In the following list,

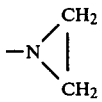

is abbreviated to

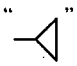

to avoid complication.

| Compound No. | Structural formula |
|---|---|
| 1. | 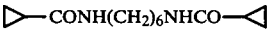 |
| 2. | 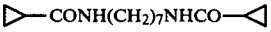 |
| 3. | 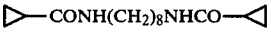 |
| 4. | 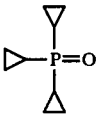 |
| 5. | 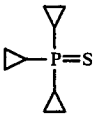 |
| 6. | 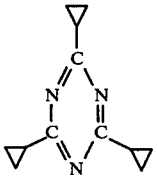 |
| 7. | 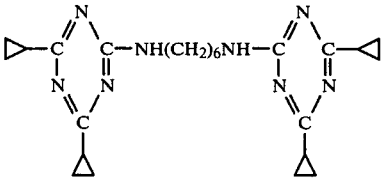 |

-continued

| Compound No. | Structural formula |
|---|---|
| 8. | 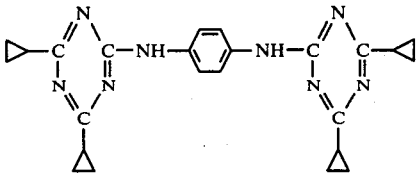 |
| 9. | 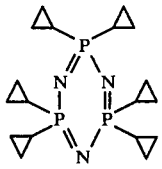 |
| 10. | 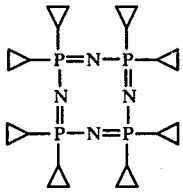 |
| 11. | 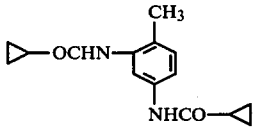 |
| 12. | 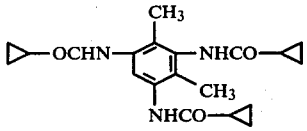 |
| 13. | 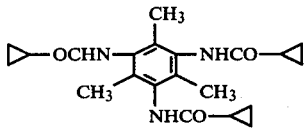 |

Examples of the compounds having at least 2 1,2-epoxy ring structures in a molecule are as follows:

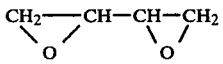 (1)

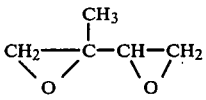 (2)

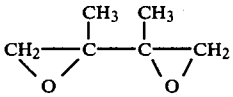 (3)

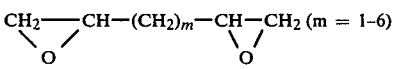 (4)

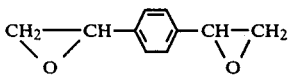 (5)

-continued (6)

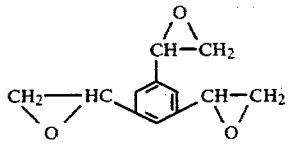

(7)

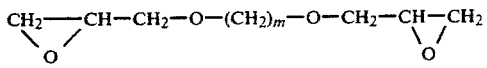

(m = 2-10)

(8)

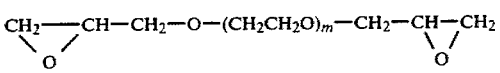

(m = 2, 3)

(9)

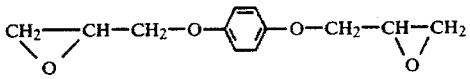

(10)

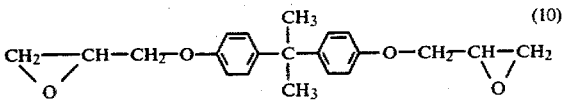

(11)

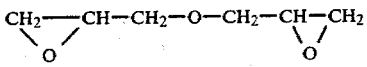

(12)

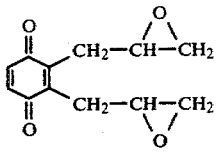

(13)

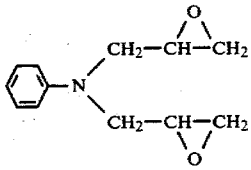

(14)

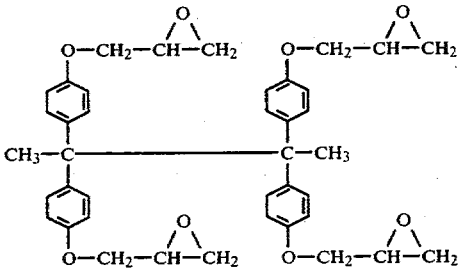

(15)

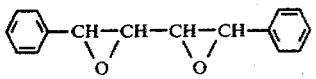

The proportion of the components constituting the antistatic composition of this invention can be varied in a wide range to meet the requirements demanded for the specific materials which should have antistatic property. The polymer binder which is the first component (a) is generally used in an amount of about 20 to about 90% by weight, preferably about 40 to about 70% by weight based on a total dry solids content of the layer composition. The colloidal silica is generally used in an amount of about 10 to about 80% by weight, preferably about 30 to about 60% by weight. The dry solid proportion of the colloidal silica to the polymer binder is generally about 30 to about 100% by weight, especially preferably about 50 to about 80% by weight. The suitable amount of the compound containing at least 2 ethyleneimino groups and/or the compound containing at least 2 epoxy groups is generally about 0.05 to about 2 parts by weight, preferably about 0.1 to about 1.0 parts by weight per 10 parts by weight of the polymer binder.

pH value of solutions comprising the antistatic composition is preferably at least about 5. It has been found that increase of the pH value results in decrease of surface resistivity, namely, increase of antistatic effect and firmer adhesion of the antistatic layer to a support.

The antistatic composition of this invention can be coated by conventional methods used for coating of aqueous solution.

For example, doctor method, roll coating method, dipping method, etc. may be employed and effects of this invention are never influenced by the kind of coating method.

Thickness of layer to be coated may be variously changed depending on the specific conditions imposed on the photographic materials. Generally, dry weight of the antistatic composition coated is about 0.5 g to about 5 g, preferably about 1 g to about 3 g per one square meter. Ordinarily, thickness of a support having polyolefin resin surface such as polyethylene laminate paper or a polypropylene sheet is in a wide range of about 50$\mu$ to about 200$\mu$. When the support has about 4 g/m$^2$ to about 7 g/m$^2$ of a hydrophilic binder mainly composed of gelatin on the side of silver halide emulsion layer, a backing layer mainly composed of gelatin in the same amount as on the side of emulsion layer is necessary considering curl balance. The curl balance becomes difficult to adjust with decrease in the thickness of support. However, it has been found that there is the unexpected effect that when the antistatic layer of this invention is provided on the back side of the support, namely, on the surface having no emulsion layer, curl balance can be kept without greatly depending on the amount of binder on the side of emulsion layer or thickness of the support even if the antistatic layer is as thin as about 1.5 g/m$^2$ as mentioned above. It has also been found that a composite antistatic layer which comprises a layer A, which consists of components (a), (b) and (c) and has a pH of at least about 5, and a layer B having the following composition which is provided between the support and the layer A and which is on the back side of the support, is an improved antistatic layer which can stand developing treatment at high temperatures, e.g., 30° C., especially high than 35° C.

Layer B: This layer is adjacent to the support, is mainly composed of water soluble polymers other than styrene-maleic anhydride copolymer and has a pH of not higher than about 5 which is lower than that of layer A.

The main object of this invention is effectively achieved by these layers A and B on the surface of a photographic support. Use of such composite antistatic layers can avoid undesired effect of static electricity and prevent peeling of an antistatic layer which occurs on development at high temperatures.

The first component which constitutes the layer B is a water soluble high molecular polymer, e.g., gelatin, a gelatin derivative, polyvinyl alcohol, polyvinylpyrrolidone, carboxymethyl cellulose, etc., which can be used at the state of pH of not higher than about 5. These may be used alone or in combination, but single use of gelatin or gelatin derivative is especially preferred. The styrene-maleic anhydride copolymer used in layer A may also be used in layer B in a small amount.

Coating amount of the water soluble high molecular polymer may be the same, more than or less than that of the styrene-maleic anhydride copolymer and it can be used in an amount of a wide range of about 0.5 g to about 10 g per one square meter.

The preferred pH value of this layer B is not higher than about 5 and it is necessary that the pH value of layer B is lower than that of layer A, preferably by at least 0.5, more preferably by at least 2. When the pH value of layer B is higher than about 5, gelatin of layer A does not proceed and hence tacky gel state of layer A cannot be obtained. In this case, after drying, antistatic layer is insufficient in adhesion to the support and peeled in a processing solution.

Preferable materials to be used in layer B are compounds of polyvalent metals such as Cr, Al, Ca, Zr, Zn and the like.

For example, chrome alum is a preferred compound. These compounds can act on the styrene-maleic anhydride copolymer in layer A to accelerate gelation and tackification. These compounds added in a suitable amount can also control too rapid tackification and gelation of layer A and as a result there is obtained an antistatic layer excellent in adhesion and having a uniform coating surface. In addition, particulate materials such as silica, polystyrene, polymethyl methacrylate, etc. can also be used. These particulate materials have a particle size of preferably 0.5 to 5μ. These particulate materials present in layer B form irregularities on the surface of layer B to exhibit an anchoring effect which provides great contact with layer A and increases adhesion with layer A. Those which have a great particle size form irregularities on the surface of layer A laminated on layer B to provide matte effect which improves acceptability for drafting materials and transportability. These particulate materials can, of course, be used in layer A, too.

Proportion of components of layer B can widely be varied depending on that of layer A. Amount of water soluble high molecular polymer is generally about 60 to about 99% by weight, preferably about 80 to 95% by weight of total dry solids content in film layer B.

Amount of the polyvalent metal compounds is preferably about 0.05 to about 10% by weight.

Amount of the particulate materials is generally about 1 to about 50% by weight, preferably about 0.5 to about 30% by weight.

The antistatic layers comprising layers A and B of this invention are not limited to those mentioned above, but may additionally contain other materials such as pH regulators, hardeners, surfactant and the like.

The antistatic layers can be coated by conventional methods, e.g., dip coating, air-knife coating, curtain coating, extrusion coating, etc. Layers A and B can be simultaneously coated or layer B is first coated and then layer A is coated.

Thus coated layers can be subsequently dried at a temperature of wide range (e.g., 20° C.–80° C.). They can also be cured with heat for a certain period of time.

Effectiveness of antistatic layers can be determined by measuring its surface resistance under specific humidity and temperature conditions as mentioned below. Measurements of other characteristics of antistatic layers were also performed in the following manners.

(1) Measurements of surface resistivity:

Samples were left in a constant temperature and humidity chamber controlled to 45–50% RH and 20° C. for 4 hours and thereafter surface resistivity was measured. The results were graded as follows:

| | |
|---|---|
| "◎" | $10^7$–$10^9$ Ω/cm$^2$ |
| "o" | $10^9$–$10^{11}$ Ω/cm$^2$ |
| "Δ" | $10^{11}$–$10^{13}$ Ω/cm$^2$ |
| "x" | more than $10^{13}$ Ω/cm$^2$ |

(2) Resistance to processing solutions:

A cross-shaped scratch was given on the antistatic layer of samples in a processing solution and the scratch portion was rubbed with a finger tip or the sample was rubbed with a finger tip from one end toward the center of the sample. Peeling degree was observed.

(3) Acceptability for drafting materials:

Record was made on the surface with pencils different in hardness and recorded state on the surface was observed.

(4) Photographic suitability:

The samples were rolled up in such a manner that the surface of the photographic emulsion layer contacted that of the antistatic layer. Then, they were left for 2 days in a chamber of 50° C. and 80% RH. Thereafter, they were developed with a given developing solution (at 30° C. for 3 minutes) and judgement was made on fog.

This invention is further illustrated by the following non-limiting examples.

EXAMPLE 1

Polypropylene synthetic papers (trade name "Yupo" manufactured by Oji Yuka K. K.) were subjected to corona discharge treatment. Then, each of the antistatic compositions as shown in Table 1 was coated on one surface of said papers in an amount of 50 g/m$^2$ by a rod bar and was dried and a high speed silver iodobromide gelatin emulsion was coated on the another side of said papers. Characteristics of thus obtained samples are compared in Table 2.

TABLE 1

| Composition | Sample No. (1) | (2) | (3) | (4) | (5) | (6) |
|---|---|---|---|---|---|---|
| 5% aqueous solution of styrene-maleic anhydride copolymer (Trade name "Malon MS" of Daido Kogyo K.K.) | 60 g | — | 60 | 60 | 60 | 60 |
| 5% aqueous solution of isobutene-maleic anhydride copolymer (Trade name "Isoban" of Kurare K.K.) | — | 60 g | — | — | — | — |
| 20% solution of colloidal silica Trade name "Snowtex" of Nissan Chemical Industries Ltd.) | 10 g | 10 | — | 10 | 10 | 10 |
| 5% alcoholic solution of compound A | 2 g | 2 | 2 | — | 2 | 2 |
| 10% solution of anionic surfactant | 4 g | 4 | 4 | 4 | 4 | 4 |
| pH | 8 | 8 | 8 | 8 | 5.5 | 4.5 |
| Water to make | 100 g (This in-ven- | 100 | 100 | 100 | 100 (This in-ven- | 100 |

TABLE 1-continued

| Composition | Sample No. (1) | (2) | (3) | (4) | (5) | (6) |
|---|---|---|---|---|---|---|
| | tion) | | | | tion) | |

Compound A

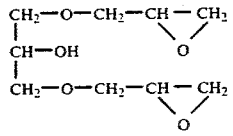

TABLE 2

| Test items | Sample No. (1) | (2) | (3) | (4) | (5) | (6) |
|---|---|---|---|---|---|---|
| Surface resistance | ◎ | x | o | o | ◎ | o |
| Resistance to processing solution | o | o | o | x | o | x |
| Acceptability for drafting materials | o | o | χ | Δ | o | o |
| Photographic suitability | o | o | o | o | o | o |
| | This invention | | | | This invention | |

As is clear from the above results, the antistatic composition [No. (2)] other than those of this invention and compositions [No. (3), No. (4) and No. (6)] which lacked some components which are essential for this invention did not satisfy either antistatic property, resistance to processing solution or acceptability for drafting materials.

On the other hand, the antistatic compositions [No. (1) and No. (5)] of this invention had good results in all tests and it was confirmed that they were excellent silver halide photographic materials having highly improved antistatic property and sufficient resistance to processing solution and acceptability for drafting materials.

EXAMPLE 2

A polyethylene laminated paper comprising a paper of 65 g/m$^2$ which was laminated with synthetic resin films of 22$\mu$ mainly composed of polyethylene was subjected to corona discharge treatment and thereafter one surface of said paper was coated with the following composition at a rate of 60 g/m$^2$ by a rod bar and dried.

| Components | |
|---|---|
| Styrene-maleic anhydride copolymer (10% by weight aqueous solution) (Trade name "Malon MS" of Daido Kogyo K.K.) | 30 g |
| Compound B (4% by weight methanolic solution) | 4 g |
| Colloidal silica (20% by weight aqueous solution) Trade name "Snowtex C" of Nissan Kagaku Kogyo K.K.) | 10 g |
| Anionic surfactant (10% by weight aqueous solution) (Trade name "Monogen GS" of Daiichi Kogyo Seiyaku K.K.) | 1 g |
| pH 8.0 | |

-continued

| Components | |
|---|---|
| Water to make | 100 g |

Compound B

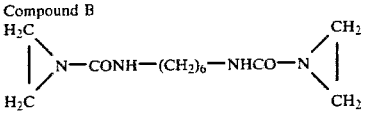

Then, an orthochromatic silver halide emulsion layer was provided on the other side of said paper to obtain a photographic printing paper. This sample was left in a constant temperature and humidity chamber of 20° C. and 30–40% RH for 6 hours and the surface of the antistatic layer was tested. The surface resistivity was 8.3 LogΩ/□. (Photographic printing paper using untreated base had a surface resistivity of 15.2 LogΩ/□.) Said sample was left in a chamber of 50° C. and 80% RH for 2 days in such state that the surface of emulsion layer contacted with the antistatic layer and thereafter was taken out from the chamber. Then, the sample was subjected to photographic developing treatment and fog test to find no trouble (blocking) on the emulsion surface nor influence (fogging) on photographic characteristic. Furthermore, peeling of layer did not occur in processing solutions and acceptability for pencils after treatment and drying was good. Moreover, the sample had good curl balance during developing treatment and after drying. For comparison, a composition was prepared by replacing colloidal silica in the above composition of this example with 2 g of silicon dioxide fine powder (Trade name "Syloid 308" of Fuji Davison K. K.) and dispersing the components by ultrasonic device. The resultant solution was coated and dried in the same manner as on said sample of this example to obtain antistatic layer.

Characteristics of this base was tested to find that surface resistivity was 12.6 LogΩ/□ which was graded as "Δ" and peeling of layer occurred in test for resistance to processing solutions to contaminate the processing solution.

EXAMPLE 3

Example 2 was repeated except that compound B was replaced with the same amount of compounds No. 6 and No. 9 having ethyleneimino groups, compounds No. (5) and No. (9) having epoxy groups which are enumerated before and combination of compounds A and B in a weight ratio of 1:1. The results were good as in Example 2. Use of compounds A and B in combination brought about especially good results.

EXAMPLE 4

Polypropylene synthetic papers (Trade name "Yupo" of Oji K. K.) subjected to corona discharge were coated with each of the following compositions at a rate of 50 g/m$^2$ by an air-knife coater to form layer B.

| | (1) | (2) | (3) | (4) |
|---|---|---|---|---|
| Gelatin | 6.3 g | " | " | " |
| Particulate silica | 0.7 g | " | " | " |
| Compound A (5% methanolic solution) | 1.2 g | " | " | " |
| Anionic surfactant (10% solution | 1.4 g | " | " | " |
| pH | 3.8 | 4.5 | 5.5 | 6.0 |

-continued

| | (1) | (2) | (3) | (4) |
|---|---|---|---|---|
| Water to make | 100 g | " | " | " |

Compound A:

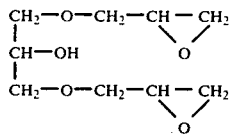

On this layer B was coated the following composition at a rate of 50 g/m$^2$ by an air-knife coater and this was dried to form layer A.

| | |
|---|---|
| 5% aqueous solution of styrene-maleic anhydride copolymer (Trade name "Malon MS" of Daido Kogyo K.K.) | 60 g |
| 20% solution of colloidal silica (Trade name "Snowtex" of Nissan Kagaku K.K.) | 10 g |
| 5% alcoholic solution of compound B | 2 g |
| 10% solution of anionic surfactant | 4 g |
| pH | 8.3 |
| Water to make | 100 g |

Compound B:

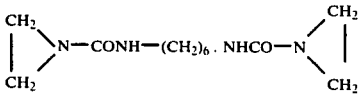

Subsequently, on the another surface of these papers which had a subbing layer was coated a high speed silver iodobromide emulsion. Characteristics of thus obtained samples were tested to obtain the results as shown in Table 3.

TABLE 3

| Test items | Layer B (1) | (2) | (3) | (4) |
|---|---|---|---|---|
| Surface resistivity | ◎ | ◎ | ◎ | ◎ |
| Resistance to processing solution 20° C. | o | o | o | Δ |
| Resistance to processing solution 35° C. | o | o | Δ | x |
| Resistance to processing solution 50° C. | o | o | x | x |
| Accetability for drafting | o | o | o | o |
| Photographic suitability | o | o | o | o |

TABLE 3-continued

| Test items | Layer B (1) | (2) | (3) | (4) |
|---|---|---|---|---|
| | This invention | | | |

As is clear from the above results, the photographic materials having antistatic compositions other than those of this invention were very inferior in resistance to processing solutions. On the other hand, the photographic materials having antistatic compositions of this invention had good results in all tests.

EXAMPLE 5

Layers A and B were coated in the same manner as in Example 4 except that 0.02 g of chrome alum was added to the composition for layer B, pH value was changed as shown in Table 4 and the compositions for layers A and B were coated in two layers by an extrusion coater. On another side of the paper was coated an orthochromatic silver halide emulsion layer. The results are shown in Table 4.

TABLE 4

| Layer A | Layer B | Coating properties | Acceptability for drafting | Photographic suitabilities | Surface resistivity | Resistance to processing solution (temperature) 20° C. | 35° C. | 50° C. | |
|---|---|---|---|---|---|---|---|---|---|
| PH = 4.0 | PH = 4.0 | x | o | o | x | o | o | Δ | |
| " | PH = 5.0 | x | o | o | x | o | o | Δ | |
| " | PH = 6.0 | Δ | o | o | Δ | o | Δ | x | |
| PH = 5.5 | PH = 4.0 | o | o | o | ◎ | o | o | o | (This invention) |
| " | PH = 5.0 | o | o | o | ◎ | o | o | o | (This invention) |
| " | PH = 6.0 | o | o | o | ◎ | o | Δ | x | |
| PH = 7.5 | PH = 4.0 | o | o | o | ◎ | o | o | o | (This invention) |
| " | PH = 6.0 | o | o | o | ◎ | o | Δ | x | |
| " | PH = 8.0 | o | o | o | ◎ | Δ | Δ | x | |
| PH = 6.5 | (Layer B was not present) | o | o | o | ◎ | Δ | x | x | |

As is clear from the above results, the photographic materials other than those of this invention were very inferior in antistatic property and/or resistance to processing solution. On the other hand, the photographic materials of this invention showed superior results in all tests.

EXAMPLE 6

The composition for layer B of pH 4.0 used in Example 5 was coated in the same manner as in Example 4 and thereafter each of the following compositions (5), (6) and (7) for layer A was coated on said layer B in the same manner as in Example 4. On another surface was coated a silber halide emulsion layer used in Example 4.

| | (5) | (6) | (7) |
|---|---|---|---|
| 5% aqueous solution of styrene-maleic anhydride copolymer (same as in Example 4) | 60g | — | 60 |
| 5% aqueous solution of isobutene-maleic anhydride copolymer (Trade | — | 60g | — |

-continued

| | (5) | (6) | (7) |
|---|---|---|---|
| name "Isoban" of Kurare K.K.) | | | |
| 20% aqueous solution of colloidal silica (same as in Example 4) | 10g | 10 | 10 |
| 5% methanolic solution of compound A | 2g | 2 | — |
| 10% solution of anionic surfactant | 4g | 4 | 4 |
| pH | 8 | 8 | 8 |

The results are shown in Table 5.

TABLE 5

| Test items | | Layer B (5) | (6) | (7) |
|---|---|---|---|---|
| Surface resistivity | | ◎ | x | o |
| Resistance to processing solution | 20° C. | o | o | Δ |
| | 35° C. | o | o | x |
| | 50° C. | o | o | x |
| Acceptability for drafting | | o | o | o |
| Photographic suitability | | o | o | o |
| | | This invention | | |

What we claim is:

1. In a silver halide photographic material which comprises a support having hydrophobic surface and at least one silver halide emulsion layer thereon, the improvement comprising an antistatic layer which comprises (a) a styrene-maleic anhydride copolymer, (b) colloidal silica and (c) at least one compound selected from the group consisting of compounds having at least 2 ethyleneimino groups in a molecule and compounds having at least 2 epoxy rings in a molecule and which has a pH value of at least about 5, said antistatic layer being provided on one or both surfaces of the support.

2. A silver halide photographic material according to claim 1, wherein the support has polyolefin resin surface.

3. A silver halide photographic material according to claim 2, wherein the polyolefin is polypropylene.

4. A silver halide photographic material according to claim 1, wherein the antistatic layer is provided on the side opposite to the surface having the emulsion layer.

5. A silver halide photographic material according to claim 4, wherein dry solids weight of the antistatic layer is 0.5–5 g/m$^2$.

6. A silver halide photographic material according to claim 5, the dry solids weight of the antistatic layer is smaller than the total dry solids weight of layers on the surface having silver halide emulsion layer.

7. A silver halide photographic material according to claim 1, wherein the component (c) is combination of compound having at least 2 ethyleneimino groups in a molecule and compound having at least 2 epoxy rings in a molecule.

8. A silver halide photographic material according to claim 1 or 4, wherein an intermediate layer mainly composed of water-soluble polymer substantially other than styrene-maleic anhydride copolymer and having a pH of not higher than about 5 is provided between the support and the antistatic layer comprising components (a), (b) and (c) of claim 1, pH value of said intermediate layer being lower than that of the upper layer.

9. A silver halide photographic material according to claim 8, wherein the intermediate layer is mainly composed of gelatin or gelatin derivatives.

10. A silver halide photographic material according to claim 8, wherein the difference in pH value of the upper layer and the intermediate layer is at least 0.5.

11. A silver halide photographic material according to 8, wherein the intermediate layer contains polyvalent metal compound.

12. A silver halide photographic material according to claim 8, where the intermediate layer contains a particulate material having a particle size of 0.5–5$\mu$.

13. A silver halide photographic material according to claim 1 wherein the amount of styrene maleic anhydride copolymer is about 20 to about 90% by weight of the dry solids of the antistatic layer, the colloidal silica is about 10 to about 80% by weight of the antistatic layer and the compound having the ethyleneimino groups or the epoxy groups is about 0.05 to 2 parts by weight per 10 parts by weight of styrene-maleic anhydride copolymer.

14. A silver halide photographic material according to claim 13 wherein the amount of styrene-maleic anhydride copolymer is about 20 to about 90% by weight of the dry solids of the antistatic layer, the colloidal silica is about 10 to about 80% by weight of the antistatic layer and the compound having the ethyleneimino groups or the epoxy groups is about 0.05 to 2 parts by weight per 10 parts by weight of styrene-maleic anhydride copolymer.

15. A silver halide photographic material according to claim 13 wherein the antistatic layer consists of the styrene-maleic anhydride copolymer, colloidal silica, compound having the ethyleneimino groups or epoxy groups and an anionic surfactant.

16. A silver halide photographic material according to claim 1 wherein the antistatic layer consists of the styrene-maleic anhydride copolymer, collodial silica, compound having the ethyleneimino groups or epoxy groups and an anionic surfactant.

17. A silver halide photographic material according to claim 1 wherein the antistatic layer consists essentially of the sytrene-maleic anhydride copolymer, colloidal silica and the compound having the ehyleneimino groups or epoxy groups.

18. A silver halide photographic material according to claim 1 wherein the antistatic layer is free of gelatin.

* * * * *